US005277429A

United States Patent [19]

Smith, III

[11] Patent Number: 5,277,429

[45] Date of Patent: Jan. 11, 1994

[54] GAME ASSEMBLY UTILIZING SOUND IDENTIFICATION FOR MOVES ON A GAME BOARD

[75] Inventor: Jay Smith, III, Los Angeles, Calif.

[73] Assignee: Smith Engineering, Culver City, Calif.

[21] Appl. No.: 14,349

[22] Filed: Feb. 5, 1993

[51] Int. Cl.[5] ..... A63F 3/00; A63F 9/24

[52] U.S. Cl. ..... 273/237; 273/249; 273/138 A; 434/335; 434/319

[58] Field of Search ..... 273/237, 138 A, 429, 249; 434/321; 434/335, 339, 169, 308, 309, 319

[56] References Cited

U.S. PATENT DOCUMENTS

| | | | |
|---|---|---|---|
| D. 85,735 | 9/1831 | DeLeon | 273/249 |
| D. 87,775 | 7/1932 | Brittingham | 273/249 |
| D. 113,535 | 10/1938 | Bradley | 273/249 |
| 3,169,768 | 2/1965 | Glass | 273/249 |
| 4,169,601 | 10/1979 | Frischmann | 273/269 |
| 4,300,770 | 12/1981 | Knetzger | 273/238 |
| 4,308,017 | 12/1981 | Laughon | 434/169 |
| 4,572,513 | 2/1986 | Evans | 273/242 |
| 4,703,573 | 12/1987 | Montgomery | 40/455 |
| 4,884,974 | 12/1989 | DeSmet | 434/317 |
| 5,106,097 | 4/1992 | Levine | 434/321 |
| 5,120,065 | 6/1992 | Driscoll et al. | 273/243 |

*Primary Examiner*—Benjamin H. Layno
*Attorney, Agent, or Firm*—Price, Gess & Ubell

[57] ABSTRACT

A game assembly utilizing sound identification as a method of determining the length of a player's move, wherein the player forfeits his turn if he fails to recognize the sound. A first player uses a keyboard to identify a randomly-generated sound, while a second player attempts to anticipate the random sound to be generated by moving panels over certain keys of the keyboard Additionally, the game assembly keyboard includes a processor which randomly appends the generated sound with a bonus sound, the player receiving an additional turn upon successful identification of the generated sound during such a bonus condition.

9 Claims, 4 Drawing Sheets

GAME ASSEMBLY UTILIZING SOUND IDENTIFICATION FOR MOVES ON A GAME BOARD

BACKGROUND OF THE INVENTION

1. Field of the Invention

The present invention relates to a game assembly utilizing sound identification and, more particularly, to a game assembly wherein sound dictates various moves on a game board.

2. Description of Related Art

The toy field is generally cognizant of games that use prerecorded audible sounds, such as U.S. Pat. No. 3,169,768, wherein a sound is produced as a result of the insertion of a peg into a preselected opening in a game board.

U.S. Pat. No. 4,169,601 discloses a sound bingo game. U.S. Pat. No. 4,308,017 discusses a hand-held electronic learning aid utilized for teaching and testing association between pictorial representations and the correct responses to the pictorial representations. U.S. Pat. No. 4,572,513 teaches an educational game having prerecorded questions and answers. U.S. Pat. No. 4,703,573 relates to an audibly activated book. Finally, U.S. Pat. No. 4,884,974 discloses an interactive talking book and audio player assembly including a ROM module within which is stored digitally-recorded spoken texts corresponding to text printed on pages of the book.

The prior art is still seeking innovative play action in sound-activated game boards.

OBJECTS AND SUMMARY OF THE INVENTION

An object is to provide a game assembly utilizing sound identification as a method of determining the length of a player's move.

An additional object is to provide a game assembly wherein a player forfeits his turn if he fails to recognize the sound.

Still another object is to provide a game assembly including a keyboard used by the player to identify a randomly-generated sound.

Yet another object is to provide an opposing player with an interactive role embodying a perceived strategy of blocking the other player's access to the keyboard with movable panels.

Another object is to provide the player with an incentive to listen with greater attentiveness as the generated sound is also randomly appended with a "bonus sound" entitling the player to an extra turn upon recognition of the generated sound.

The game assembly, utilizing sound identification, includes a plurality of game pieces, a board, a keyboard, a sound-generating processor, and a speaker. The game is won by advancing a game piece from a start location on the board along a path that connects the start location to a finish location via game piece locations. The game piece locations are provided with indicia corresponding to objects with characteristic audible sounds. A player's turn is initiated by selecting a random sound generation key on the keyboard. The sound-generating processor receives this input from the keyboard, randomly selects stored data, on a sound characteristic of one of the objects associated with the game piece locations, and outputs a drive signal to a speaker which reproduces the randomly-selected object's characteristic audible sound. The player advances his game piece by recognizing this sound and thereafter correctly selecting a dedicated key on the keyboard corresponding to the identified sound. An opposing player may interactively participate by blocking a predetermined number of the dedicated keys with movable panels, thereby embodying a perceived strategy of defense. Additionally, a "bonus sound," such as a buzzer sound, randomly follows the randomly-selected object's characteristic audible sound. Upon successful recognition of a randomly-generated sound which is accompanied with the "bonus sound," the player is entitled to an extra turn and, accordingly, is encouraged to listen more attentively.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a game assembly with sound identification.

Figures 1A, 1B:
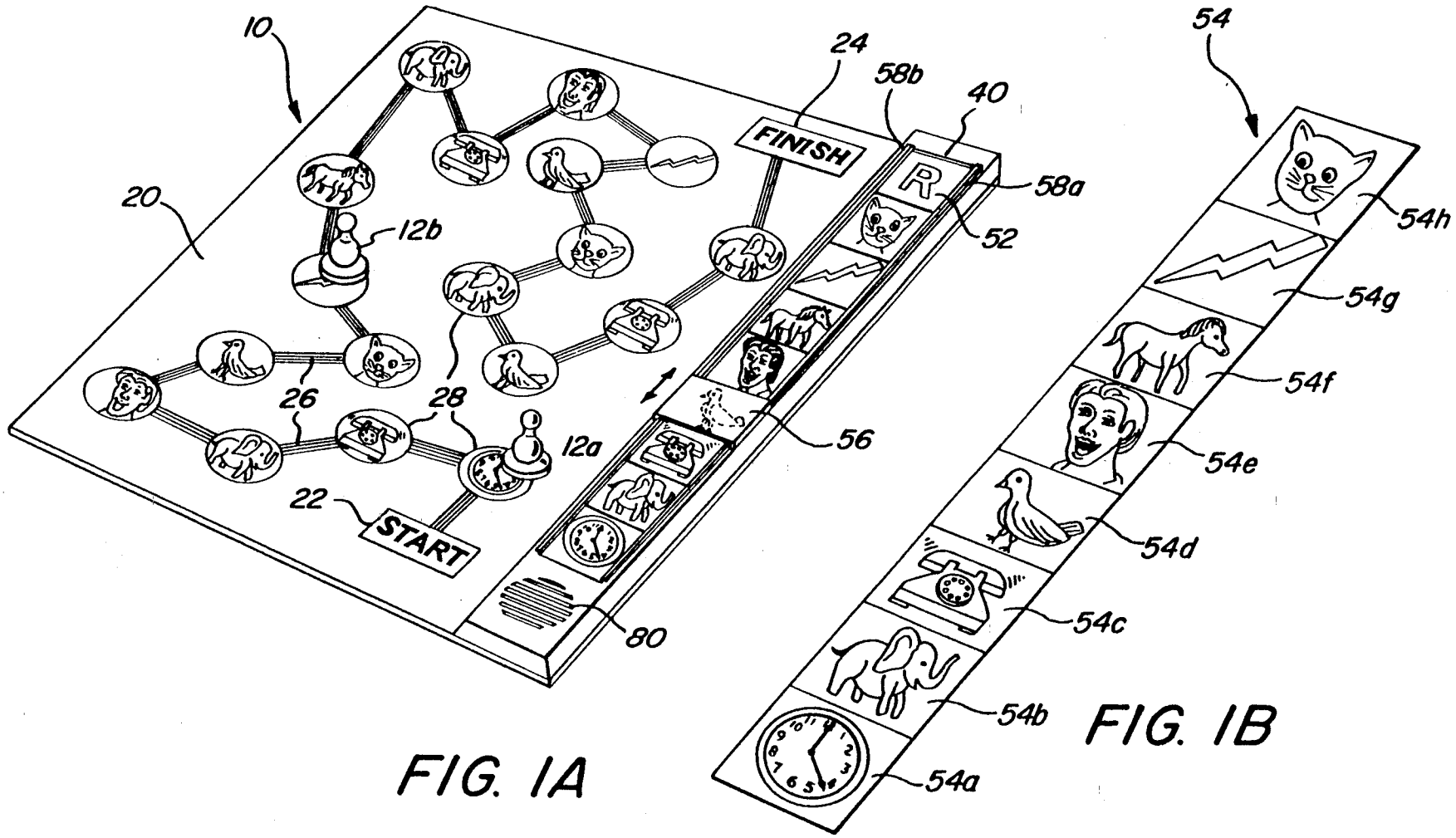
FIG. 1*a* is a schematic perspective showing a game assembly with sound identification.
FIG. 1*b* is an enlarged view of the game assembly's dedicated keys.
Figure 2:
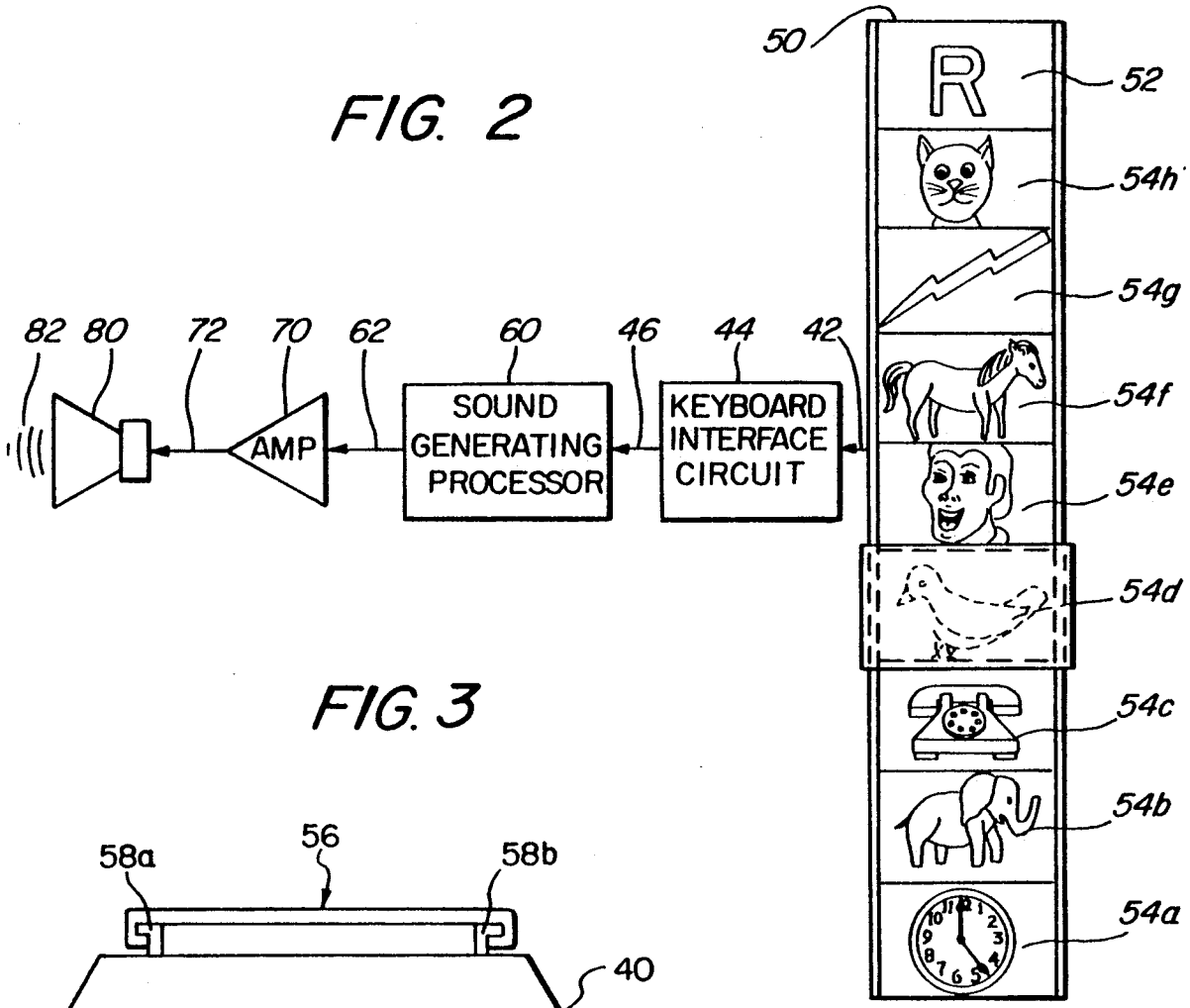
FIG. 2 is an expanded view of the keyboard assembly.

FIG. 1*a* shows a game assembly 10 with sound identification, a keyboard assembly 40 attached thereto, and game pieces 12*a*, 12*b*. FIG. 2 is an expanded view of keyboard assembly 40 and shows keys 50, sound-generating processor 60, amplifier 70, and speaker 80. As seen in FIG. 1*a*, board 20 is marked with a start location 22 and a finish location 24. Additionally, colorful indicia can be printed on the board to complement the particular type of game play. Board 20 also includes path indicia 26 between the start location 22 and the finish location 24. Along path 26 are a plurality of individual game piece locations or sites 28. Each such game piece location is provided with specific indicia corresponding to an object that a child might associate with a particular characteristic sound, e.g., a cat with a meowing sound. A player advances his game piece 12 from the start location 22, sequentially, via game piece locations 28, to the finish location 24 by recognizing sounds that correspond to the objects which are labeled on the game piece locations 28. More specifically, and as seen in FIG. 1*a*, a player who hears the sound of a lightning bolt, and recognizes it as such, earns the right to move game piece 12*b* to the first location labeled as a lightning bolt. Note, repetitive locations could use the same labeled indicia.

FIGS. 1*a*, 1*b*, and 2 show that keyboard assembly 40 includes a plurality of keys 50. At least one of these keys is a random sound generation key 52, and the remaining dedicated keys 54 are provided with indicia corresponding to the same object icons for labeling game piece locations 28. A player starts his turn by activating the random sound generation key 52, which initiates a random generation of a sound commonly thought to be made by one of the objects disclosed on the dedicated keys 54. Dedicated keys 54, in a preferred embodiment, comprise dedicated keys 54*a*–54*h*. These dedicated keys 54*a*–54*h*, as pictured in FIG. 1*b*, might be respectively labeled as a ticking clock, elephant, ringing telephone, bird, laughing man, horse, lightning bolt, and cat. Random sound generation key 52 randomly determines the position of the player's move. The player, after successful recognition of the randomly-generated sound by activating the appropriate dedicated keys 54, moves game piece 12 to the game piece location 28, which is labeled with the object characteristically associated with the recognized sound. Game assembly 10 utilizes keyboard assembly 40 as an interactive method of determining the length of a player's move along path 26. The player is encouraged to pay attention, since he forfeits his turn should he fail to recognize and successfully identify the randomly-generated sound.

Figure 3:
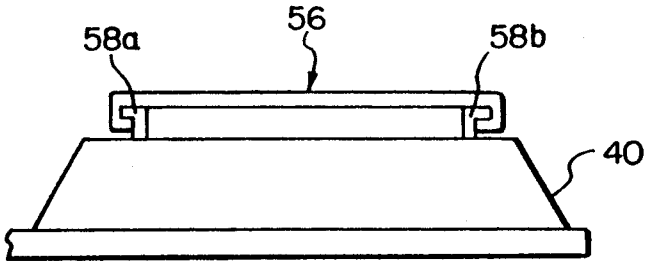
FIG. 3 is a cross-sectional view of a keyboard assembly including a cross-sectional view of the keyboard assembly's moving panel and support rails.

As seen in FIGS. 1 and 3, game assembly 10 embodies additional inventive features such as at least one movable panel 56, which can be manually slid along support rails 58*a*, 58*b* over the dedicated keys 54. Before a first player initiates his turn by selecting random sound generation key 52, a second player positions the movable panel 56 over a dedicated key 54 which he believes may correspond to the forthcoming randomly-generated sound. Should the second player correctly guess which sound will next be randomly generated, by demonstrating such intuition via proper placement of movable panel 56, the first player is thereby denied an opportunity to advance his game piece 12 even if the first player correctly identifies the randomly-generated sound. Thus, the second player implements a defense embodying a perceived strategy and also remains interested in the game even if it is not his turn.

FIG. 2 shows that keyboard assembly 40 generates a keyboard selection signal 42 indicative of which key 50 is selected by the player. Keyboard interface circuit 44 receives the keyboard selection signal 42 and outputs a processor input signal 46 to the sound-generating processor 60. The amplifier 70 receives an amplifier input signal 62 from sound-generating processor 60 and outputs drive signal 72 to speaker 80 which, in turn, generates an audio output 82. When a player selects dedicated key 54*a*, for example, the sound-generating processor 60 receives a keyboard selection signal 42 indicating that the player selected dedicated key 54*a*. In response thereto, sound-generating processor 60 outputs an amplifier input signal 62 commanding speaker 80, via amplifier 70, to reproduce an audio output 82 recognizable by the player as a ticking clock.

In a preferred embodiment, sound-generating processor 60 randomly appends its drive signal 62 with a "bonus sound." Such a bonus sound may, but does not necessarily, follow the randomly-generated sound. When a player hears the "bonus sound," he has additional incentive to correctly identify the randomly-generated sound corresponding to dedicated keys 54*a*–54*h* because successful identification thereof entitles the player to an additional turn.

Figure 5:
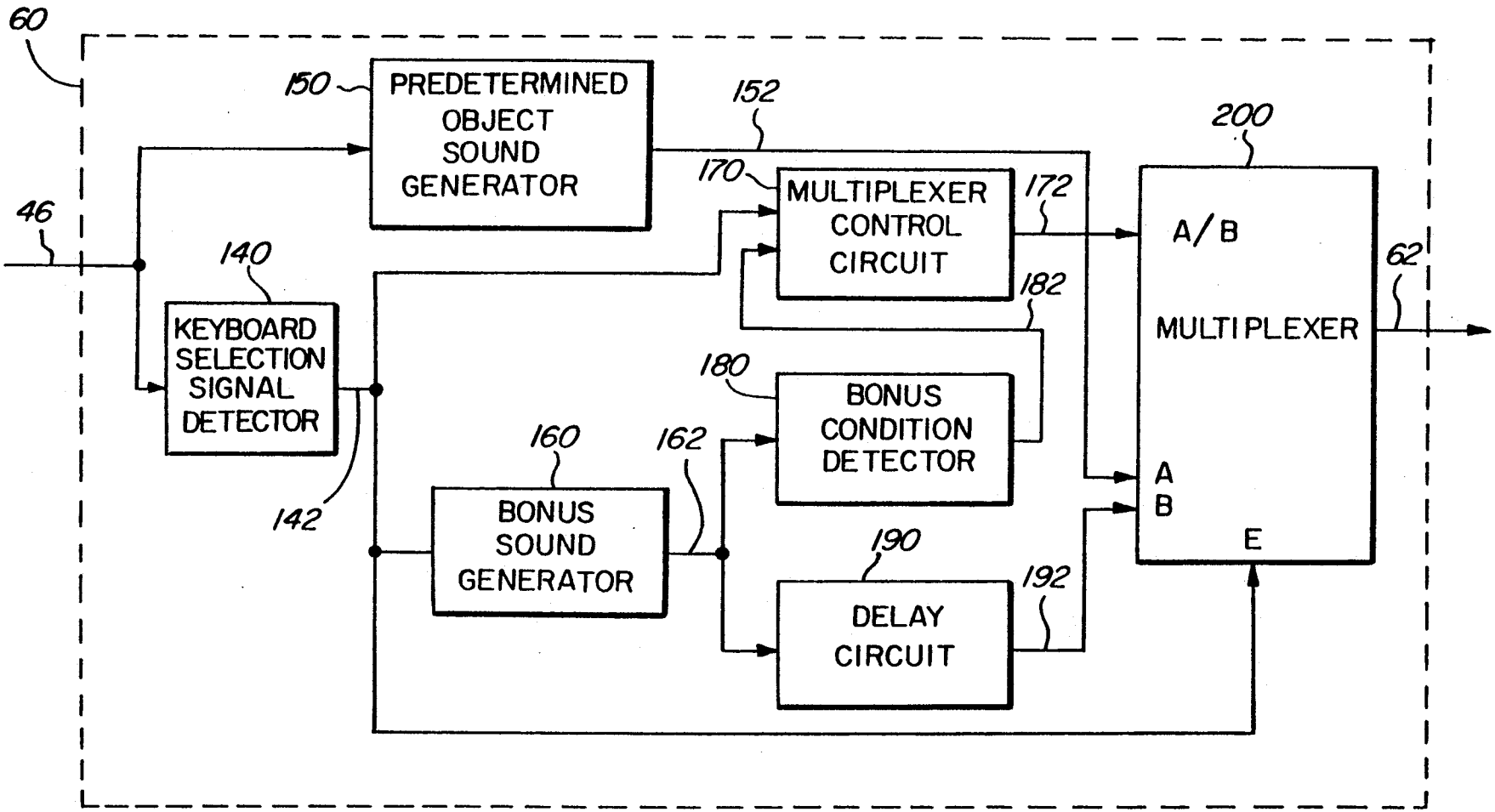
FIG. 5 is a block diagram of the game assembly's sound-generating processor.

FIG. 5 shows sound-generating processor 60 in greater detail. Processor input signal 46 is received by keyboard selection signal detector 140 and by predetermined object sound generator 150. Information contained within processor input signal 46 is used by predetermined object sound generator 150 to output a predetermined object sound signal 152. When a player touches any one of dedicated keys 54*a*–54*h*, the predetermined object sound generator 150 outputs a predetermined object sound signal 152 corresponding to the object indicia labeling the selected dedicated key. When a player selects the random sound generation key 52, the predetermined object sound generator 150 randomly selects one of the predetermined objects and outputs a predetermined object sound signal 152 corresponding thereto.

Processor input signal 46 is also used by keyboard selection signal detector 140 to produce a keyboard activation signal 142, which indicates when a player first touches any of keys 50. Keyboard activation signal 142 serves several purposes and is output to a bonus sound generator 160, a multiplexer control circuit 170, and a multiplexer 200. Upon receipt of keyboard activation signal 142, the bonus sound generator 160 randomly determines whether a bonus condition exists and, if such a condition is determined to exist, outputs a bonus sound signal 162 containing information necessary to reproduce the bonus sound. Keyboard activation signal 142 is also important because it enables multiplexer 200 to output the amplifier input signal 62 of sound-generating processor 60.

Multiplexer control circuit 170, bonus condition detector 180, and delay circuit 190 ensure that the bonus sound follows the predetermined object sound. Bonus sound signal 162 is time delayed through delay circuit 190, which outputs a delayed bonus sound signal 192. In a preferred embodiment, the time lag introduced by delay circuit 190 is approximately the same amount of time required for speaker 80 to reproduce the sound characteristically associated with the randomly-selected object. As with predetermined object sound signal 152, delayed bonus sound signal 192 is also provided as an input to multiplexer 200. Multiplexer control circuit 170 generates a multiplexer input selector signal 172, which is provided to multiplexer 200. Multiplexer input selector signal 172 determines which of the predetermined object sound signal 152 and the delayed bonus sound signal 192 should pass through multiplexer 200 to be output as amplifier input signal 62 Since multiplexer 200 only outputs the amplifier input signal 62 when a player has selected one of keys 50, the keyboard activation signal 142 is used to enable multiplexer 200.

Bonus condition detector 180 receives bonus sound signal 162 and outputs a bonus condition status signal 182 when the bonus sound generator 160 outputs a bonus sound signal indicative of the bonus condition. Multiplexer control circuit 170 receives keyboard activation signal 142 and bonus condition status signal 182 and generates multiplexer input selector signal 172 such that predetermined object sound signal 152 first passes through multiplexer 200, and then delayed bonus sound signal 192 passes therethrough. Multiplexer control circuit 170 prevents contention between the predetermined object sound and the bonus sound.

Although FIG. 1 illustrates a single path 26 between start location 22 and finish location 24, board 20 and, more specifically, game piece locations 28, can be interconnected in a variety of ways, possibly creating a plurality of paths 26 between start location 22 and finish location 24. Similarly, keyboard assembly 40 need not be physically connected to board 20 and may exist in a variety of embodiments which are not necessarily limited to eight dedicated keys 54 or to a single movable panel 56. Furthermore, sound-generated processor 60 may output an amplifier input signal 62, which is a function of factors other than which key 50 was last selected by a player and whether or not the aforedescribed bonus condition exists.

Selection of specific componentry for game assembly 10, in a preferred embodiment, includes designating speaker 80 as a one-inch coil driver. Such a choice results in a reasonably-priced speaker 80 which is capable of reproducing a pleasingly wide range of audible frequencies. Sound-generating processor 60, as exemplified in FIG. 5, can be implemented in a single, or in several, voice synthesizers which are commercially available from Winbond, Texas Instruments, and other companies. Those proficient in the art understand that the selection of sound-generating processor 60 determines the nature and extent of keyboard interface circuitry 44 existing between keyboard assembly 40 and sound-generating processor 60.

Figure 4:
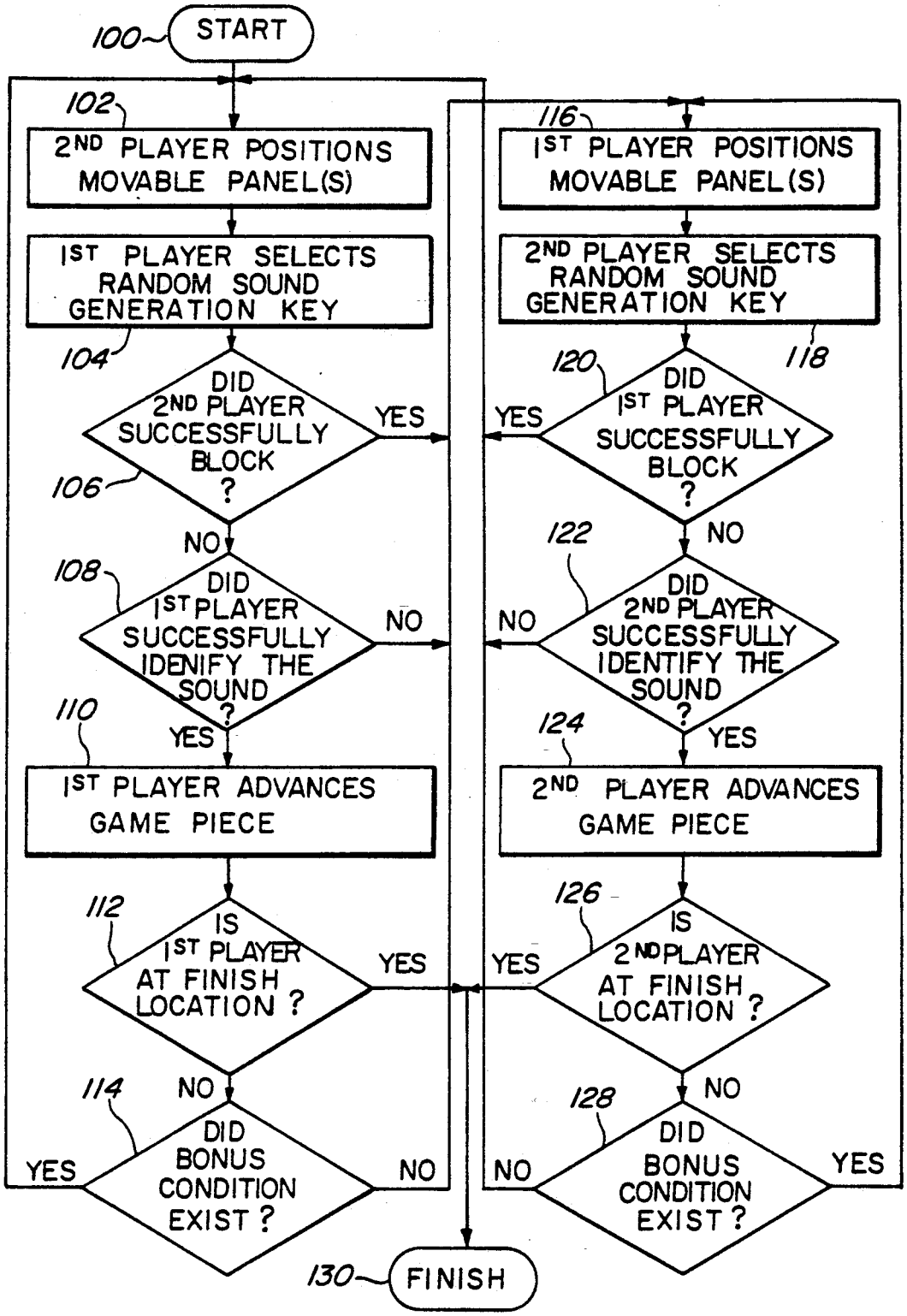
FIG. 4 is a flow chart showing the steps taken by a player while playing the game assembly.

The disclosed subject matter can also be viewed as a method of using sound identification to determine various movements on a game board. FIG. 4 is a block diagram showing how a game between a first player and a second player might progress. At step 100, the two players determine who will be the first player and who will be the second player. Next step 102 shows that the second player positions the movable panels 56 over dedicated keys 54*a*–54*h* in an attempt to block the first player's selection thereof. In step 104, the first player selects the random sound generation key 52 to generate audio output 82. Step 106 indicates that if the second player successfully blocked the correct identification of audio output 82 by the first player, then the players go to step 116. Only if the second player did not successfully block the first player's identification of audio output 82 does the first player have a reason to attempt successful identification of the sound. Step 108 shows that the first player's turn is over if he fails to successfully identify audio output 82.

Step 110 indicates that upon the first player's successful identification of audio output 82, via connect selection of dedicated key 54*a*–54*h*, the first player is entitled to advance his game piece 12 to the game piece location corresponding to the identification sound. Step 112 indicates that if step 110's movement puts the first player's game piece 12 over the finish location, the players proceed to step 130 and the game is over. However, if the first player has not yet completed his journey to the finish location, step 114 provides that he is entitled to an additional turn if the bonus condition existed during his successful identification of audio output 82. If such a bonus condition existed, the first player returns to step 102 and receives a second turn.

Once it is the second player's turn, steps 116–128 narrate a similar progression for that player. The contemplated subject matter envisions a board game wherein a variety of different rules might govern movement of game pieces 12*a*, 12*b* over board 20. In a preferred embodiment, a player is entitled to land upon finish location 24 and win the game if, and only if, he successfully identifies audio output 82 during the existence of the bonus condition, and if there are no other game piece locations 28 located between the player's game piece 12 and finish location 24 that are not covered by movable panels 56.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed Is

1. A game comprising:

a plurality of game pieces;

a board with a start location and a finish location, the board including a plurality of separate game piece locations extending between the start and finish locations, each of the game piece locations being provided with indicia corresponding to one of a plurality of predetermined objects, each object being associated with a characteristic audible sound;

a keyboard with a plurality of keys including a plurality of dedicated keys and one random sound generation key, each dedicated key being provided with indicia corresponding to one of said plurality of predetermined objects, the keyboard generating a keyboard selection signal indicating which of the plurality of keys is selected by a first player of said game;

a sound-generating processor receiving and processing said keyboard selection signal and outputting a drive signal, the drive signal being a function of which of said plurality of keys is selected; and a speaker receiving said drive signal and generating an audio output corresponding to one of said object's characteristic audible sounds;

wherein, when said random sound generation key is selected, said sound-generating processor randomly selects one of said sounds characteristic of one of the objects and generates said drive signal such that said speaker's audio output corresponds thereto;

wherein, when one of said plurality of dedicated keys is selected, said sound-generating processor again generates said drive signal such that said speaker's audio output corresponds to said object associated with said selected dedicated key;

wherein said first player starts said game, and initiates latter turns, by selecting said random sound generation key to generate said audio output signal corresponding to one of said plurality of objects, a goal of said first player is to successfully advance his game piece from said start location to said finish location via said separate game piece locations, said first player advancing his game piece to said game piece location associated with said randomly-generated object's characteristic audible sound after successfully identifying said audible sound by selecting said dedicated key corresponding thereto.

2. The game of claim 1 wherein said plurality of dedicated keys comprises eight dedicated keys.

3. The game of claim 1 wherein said keyboard further includes a plurality of movable panels for respectively blocking access to one of said plurality of keys and a means for supporting the plurality of movable panels above said plurality of keys and permitting each panel to be positioned over one of said plurality of keys, the plurality of movable panels are positioned as desired by a second player to block said first player from successfully identifying said object's characteristic audible sound.

4. The game of claim 1, further including means for generating a bonus sound in addition to said object's characteristic audible sounds, wherein said sound-generating processor's drive signal is further a function of a bonus condition recognized by said sound-generating processor, a successful identification of said object's characteristic audible sound when the bonus condition exists entitles said first player to an additional turn, the bonus condition being audibly recognizable by said first player thereby encouraging said first player to listen with more attention.

5. The game of claim 4 wherein said bonus condition is randomly generated by said sound-generating processor, said bonus condition is recognizable as a bonus sound appended to said object's characteristic audible sound.

6. The game of claim 5 wherein said plurality of dedicated keys comprises eight dedicated keys.

7. A game comprising:

a plurality of game pieces;

a board with a start location and a finish location, the board including a plurality of separate game piece locations, extending between the start and finish locations, each of the game piece locations being provided with indicia corresponding to one of a plurality of predetermined objects, each object being associated with a characteristic audible sound;

a keyboard with a plurality of keys including a plurality of dedicated keys and one random sound generation key, each dedicated key being provided with indicia corresponding to one of said plurality of predetermined objects, the keyboard generating a keyboard selection signal indicating which of the plurality of keys is selected by a first player of said game, the keyboard further including at least one movable panel for blocking one of the plurality of keys and a means for supporting the movable panel above the plurality of keys to permit the panel to be positioned over one of the plurality of keys;

sound-generating processor means for receiving and processing said keyboard selection signal and outputting a drive signal, the drive signal being a function of which of said plurality of keys is selected, and also randomly an additional drive signal indicative of a bonus condition; and a speaker receiving said drive signal and generating an audio output corresponding to one of said object's characteristic audible sounds;

wherein, when said random sound generation key is selected, said sound-generating processor randomly selects one of said plurality of objects and generates said drive signal such that said speaker's audio output corresponds thereto;

wherein, when one of said plurality of dedicated keys is selected, said sound-generating processor generates said drive signal such that said speaker's audio output corresponds to said object associated with said selected dedicated key;

wherein said first player starts said game, and initiates latter turns, by selecting said random sound generation key to generate said audio output signal corresponding to one of said plurality of objects, a goal of said first player is to successfully advance his game piece from said start location to said finish location via said game piece locations, said first player advancing his game piece to said game piece location associated with said randomly-generated object's characteristic audible sound after successfully identifying said audible sound by selecting said dedicated key corresponding thereto, said movable panel being positioned as desired by a second player to attempt to block said first player from successfully identifying said audible sound, a successful identification of said audible sound when said bonus condition exists entitling said first player to an additional turn.

8. The game of claim 6 wherein said bonus condition is randomly generated by said sound-generating processor, said bonus condition is recognizable as a bonus sound appended to said object's characteristic audible sound.

9. A method for determining game piece movement for a game utilizing sound identification, the game including a plurality of game pieces, a board, and a keyboard assembly, the board further including a plurality of game piece locations provided with indicia corresponding to one of a plurality of predetermined objects, each object being associated with a characteristic audible sound, the keyboard assembly further including a speaker capable of generating an audio output, a plurality of dedicated keys provided with indicia corresponding to one of said plurality of predetermined objects, and one random sound generation key, the speaker being enabled and reproducing an audible output corresponding to the indicia of whichever dedicated key is selected when a dedicated key is selected, the speaker being enabled and reproducing an audible output corresponding to one of the object's characteristic audible sounds, the object being randomly selected from the plurality of objects, when the random sound generation key is selected, the method including the steps of:

initiating a player's turn by selecting said random sound generation key to enable said speaker to generate said audio output corresponding to said randomly-selected object's characteristic audible sound;

identifying said randomly-generated audible sound by selecting said dedicated key corresponding thereto; and advancing said player's game piece to said game piece location corresponding to said randomly-generated audible sound, upon correct identification of said randomly-generated audible sound by said player.

* * * * *